US010468167B2

(12) United States Patent
Sun et al.

(10) Patent No.: US 10,468,167 B2
(45) **Date of Patent: *Nov. 5, 2019**

(54) HIGH-PERFORMANCE NDFEB PERMANENT MAGNET PRODUCED WITH NDFEB SCRAPS AND PRODUCTION METHOD THEREOF

(71) Applicant: SHENYANG GENERAL MAGNETIC CO., LTD., Shenyang, Liaoning (CN)

(72) Inventors: Baoyu Sun, Liaoning (CN); Yongli Duan, Liaoning (CN)

(73) Assignee: SHENYANG GENERAL MAGNETIC CO., LTD, Shenyang, Liaoning (CN)

( * ) Notice: Subject to any disclaimer, the term of this patent is extended or adjusted under 35 U.S.C. 154(b) by 186 days.

This patent is subject to a terminal disclaimer.

(21) Appl. No.: 15/401,262

(22) Filed: Jan. 9, 2017

(65) Prior Publication Data

US 2017/0117073 A1 Apr. 27, 2017

(30) Foreign Application Priority Data

Apr. 8, 2016 (CN) ..... 2016 1 0215686

(51) Int. Cl.

| | |
|---|---|
| ***H01F 1/057*** | (2006.01) |
| ***H01F 41/02*** | (2006.01) |
| ***B22F 7/02*** | (2006.01) |

(52) U.S. Cl.
CPC ..... *H01F 1/0577* (2013.01); *H01F 41/0273* (2013.01)

(58) Field of Classification Search
CPC ..... H01F 1/0577; H01F 41/0273
See application file for complete search history.

(56) References Cited

U.S. PATENT DOCUMENTS

| | | | | |
|---|---|---|---|---|
| 2003/0106615 | A1* | 6/2003 | Hirota | C22B 7/002 148/101 |
| 2007/0157998 | A1* | 7/2007 | Hirota | C22C 1/0441 148/302 |
| 2017/0098496 | A1* | 4/2017 | Sun | C22C 38/16 |
| 2017/0103837 | A1* | 4/2017 | Sun | H01F 1/0577 |

* cited by examiner

*Primary Examiner* — Xiaowei Su

(57) ABSTRACT

A high-performance NdFeB permanent magnet produced with NdFeB scraps and a production method thereof are provided. The production method includes steps of: under a vacuum condition, sending a portion of raw materials, including pure iron, ferro-iron, the NdFeB scraps and rare earth fluorides, into a crucible, refining, and obtaining a first melting liquid; absorbing slags by a slag cleaning device, and moving the slag cleaning device out; sending a rest of raw materials into the crucible, refining the first melting liquid and the rest of raw materials in the crucible, and obtaining a second melting liquid; pouring the second melting liquid after refining onto a surface of a water-cooled rotation roller through a tundish, and forming alloy flakes; processing the alloy flakes with hydrogen decrepitation, milling the alloy flakes into powders by a jet mill, then magnetic field pressing, presintering and sintering.

13 Claims, 2 Drawing Sheets

HIGH-PERFORMANCE NDFEB PERMANENT MAGNET PRODUCED WITH NDFEB SCRAPS AND PRODUCTION METHOD THEREOF

CROSS REFERENCE OF RELATED APPLICATION

The application claims priority under 35 U.S.C. 119(a-d) to CN 201610215686.5, filed Apr. 8, 2016.

BACKGROUND OF THE PRESENT INVENTION

Field of Invention

The present invention relates to a rare earth permanent magnet field, and more particularly to a high-performance NdFeB permanent magnet produced with NdFeB scraps and a production method thereof.

Description of Related Arts

Because of the excellent magnetism, the rare earth permanent magnet material is more and more widely applied in medical magnetic resonance imaging, computer hard disk driver, sound system, and mobile phone. With the energy-saving and low-carbon economy requirements, the NdFeB rare earth permanent magnet material is further applied in fields of auto parts, household appliance, energy-saving control motor, hybrid electric vehicle, and wind power generation.

In 1983, Japanese patent publications JP1,622,492 and JP2,137,496 firstly disclosed a NdFeB rare earth permanent magnet material, and characteristics, components and a production method thereof. American patent publications U.S. Pat. Nos. 6,461,565, 6,491,765, 6,537,385, 6,527,874 and 5,645,651 also disclosed the production method of the NdFeB rare earth permanent magnet.

Conventionally, in order to produce the high-performance rare earth permanent magnet material, a vacuum melting rapid-solidifying method is generally adopted to prepare the rare earth permanent magnet alloy. According to the conventional vacuum melting rapid-solidifying process, the rapid-solidifying alloy raw materials, such as the pure iron, the ferro-iron, the rare earth raw materials and other additive metals, are added into the crucible at one time for melting, in such a manner that the relatively precious raw materials such as the rare earth may volatilize under a high temperature during a melting process. Moreover, under an atmosphere environment, the addition of the raw materials into the crucible leads to the oxidized rare earth material and an increase of the generated slags during melting. The above factors affect the use ratio of the precious metal material, and lead to certain wastes. The vacuum melting rapid-solidifying furnace, produced by Ulvac Japan Ltd., adopts a design of secondary loading, for filling the loading space caused by the melted raw materials in the crucible during the melting process, and increasing a loading amount. However, the vacuum melting rapid-solidifying furnace is failed to solve the problems of the loss of the precious alloy raw materials under the high temperature and the seriously generated slags caused by melting the rare earth raw materials.

During the producing process of the NdFeB rare earth permanent magnet, the NdFeB raw materials are generally melted into the alloys, then the NdFeB alloys are sintered into the NdFeB block through the powder metallurgy method, and finally the NdFeB block is machined into the parts having different shapes. Because NdFeB is hard and crisp, during machining, a large number of leftover materials are generated. Moreover, as time goes by, because of having the fault or reaching the end of the service life, some mechanical devices produced with the NdFeB rare earth permanent magnet are out of use, and a large number of the scrapped NdFeB permanent magnet are able to be recycled. Because the rare earth permanent magnet material has a relatively high cost, people in the industry are always trying to research and develop a method for recycling the rare earth permanent magnet scraps, such as the rare earth permanent magnet defective products, the leftover materials, and the scrapped NdFeB permanent magnet, so as to decrease a raw material cost of the rare earth permanent magnet material and save the available natural resource. Because the above rare earth permanent magnet scraps have a relatively high oxidation degree, if the scraps as the melting raw materials are remelted and recycled, a large number of the slags will generated during melting. The above problem limits the scrap remelting process and the wide application thereof. Thus, the related Japanese enterprises generally recycle the rare earth permanent magnet scraps without adopting the remelting process. For example, Chinese patent application, ZL99800997.0, and American patent publication, U.S. Pat. No. 6,149,861, disclosed a method for recycling the sintered NdFeB scraps. According to the method, the scraps are processed with crushing, pickling and drying, and a product is obtained; then the product is processed with a calcium reduction treatment, and then the recyclable raw material alloy powders are obtained; through adding other alloy powders into the recyclable raw material alloy powders, a composition thereof is adjusted; and finally the sintered NdFeB permanent magnet material is produced. Chinese patent application, ZL02800504.X, and American patent publication, U.S. Pat. No. 7,056,393, disclosed a method which utilizes the sintered NdFeB defective products. According to the method, the sintered NdFeB defective products are processed with coarse grinding through a hydrogen decrepitation process, and the fine powders are formed; the fine powders produced by the defective products are mixed with the fine powders produced by the normal raw materials, and finally the sintered NdFeB permanent magnet is produced. The above methods, which utilize the scraps without adopting the remelting process, not only have the relatively complex process, but also have to prepare the alloy powders having the different compositions for adjusting the composition and improving the sintering performance thereof, which brings troubles to the producing process. More importantly, according to the above scarp utilization methods, because the scraps are not remelted, the powders produced by the scraps have a relatively high content of oxygen and other impurities, so that the magnetic performance of the obtained rare earth permanent magnet material is greatly affected.

With the application of the NdFeB rare earth permanent magnet in wind power generation, automobiles, servo motors, energy-saving motors and electronic devices, the consumption of the heavy rare earth element, Dy, becomes more and more. Dy is a scarce heavy rare earth resource and few in the world, and now only produced from the ionic mineral in south China. A decrease of the consumption of Dy is important for protecting the scarce resource and decreasing the cost of the NdFeB rare earth permanent magnet.

In order to increase the magnetic performance of the NdFeB rare earth permanent magnet material and meanwhile decrease the consumption of heavy rare earth materials such as Dy and Tb, Japanese enterprises have made a lot of researches. Japanese Shin-Etsu Chemical Co., Ltd. in Chinese patent publications, CN100520992C, CN100565719C, and CN101404195B, disclosed a high-performance R—Fe—B permanent magnet containing Dy, Tb, F and O. The average concentrations of F, Dy and Tb gradually increase from a center of the magnet to a surface of the magnet, and the distribution trends thereof are showed in FIG. 1. Moreover, rare earth oxyfluorides exist in the grain boundary of the grain boundary area which is from the surface of the magnet to an interior of the magnet at a certain depth. The permanent magnet is prepared through steps of: sintering the NdFeB magnet; adding oxides, fluorides or oxyfluoride powders containing Dy and Tb on the surface of the magnet; processing the magnet with a thermal treatment at a temperature lower than a sintering temperature in vacuo or an inert atmosphere; and absorbing Dy and Tb in the powders into the magnet. Through the above method, the coercive force of the sintered NdFeB permanent magnet is increased to a certain extent. However, according to the above method, the thermal treatment, which enables Dy and Tb to penetrate into the magnet, proceeds after sintering, causing the magnet becoming more crisp and harder, which brings troubles to subsequent machining and processing, leads to the easily broken edges and corners of the products during the transport process, and increases the rejection rate of the products.

SUMMARY OF THE PRESENT INVENTION

Rare earth is a scarce strategic resource, especially the heavy rare earth element Dy which is few, and thus producing a high-performance NdFeB rare earth permanent magnet with NdFeB scraps becomes very important. Because a lot of impurities and oxides are brought by the NdFeB scraps, which seriously affects a vacuum melting process and obviously decreases a product quality, the present invention, through adding rare earth fluorides, especially through adding praseodymium fluorides, neodymium fluorides, dysprosium fluorides and terbium fluoride powders respectively or together, obtains an obvious effect. In pure iron and ferro-boron, which serve as raw materials of NdFeB, a content of Mn is relatively high, which seriously affects a magnetic performance of NdFeB; and, how to decrease the content of Mn in the NdFeB rare earth permanent magnet is a difficult problem in NdFeB industry. According to the present invention, through controlling a vacuum degree, controlling a refining temperature and adding the rare earth fluorides, the content of Mn is obviously decreased, generally controlled in a range of 0.011-0.027 wt % and further in a range of 0.011-0.016 wt %.

Technical solutions of the present invention are described as follows.

A high-performance NdFeB permanent magnet produced with NdFeB scraps is provided, wherein: an average grain size of the NdFeB permanent magnet is in a range of 3-7 μm; the NdFeB permanent magnet comprises a main phase and a grain boundary phase; the grain boundary phase is distributed around the main phase; the main phase contains Pr, Nd, Mn and Co; the grain boundary phase contains Zr, Ga, Cu and F; a composite phase containing Tb and N exists between the main phase and the grain boundary phase; and, contents of N, F, Mn, Tb, Pr, Nd, Co, Ga, Zr and Cu in the NdFeB permanent magnet are respectively 0.03 wt %≤N≤0.09 wt %, 0.004 wt %≤F≤0.5 wt %, 0.011 wt %≤Mn≤0.027 wt %, 0.1 wt %≤Tb≤2.9 wt %, 3 wt %≤Pr≤14 wt %, 13 wt %≤Nd≤28 wt %, 0.6 wt %≤Co≤2.8 wt %, 0.09 wt %≤Ga≤0.19 wt %, 0.06 wt %≤Zr≤0.19 wt %, and 0.08 wt %≤Cu≤0.24 wt %.

Preferably, the main phase has a structure of $R_2T_{14}B$; the composite phase comprises a phase having a structure of $(R, Tb)_2T_{14}(B, N)$; and the composite phase further comprises a phase having a structure of $(R, Tb)T_{12}(B, N)$; wherein: T represents transition metal elements, and comprises Fe, Mn and Co; and, R represents at least one rare earth element, and comprises Pr and Nd.

Preferably, the main phase further contains Mn; the grain boundary phase further contains Ti; and contents of Mn and Ti in the NdFeB permanent magnet are respectively 0.01 wt %≤Mn≤0.016 wt % and 0.08 wt %≤Ti≤0.35 wt %. Mn is impurities brought by raw materials of NdFeB, and a content of Mn in a NdFeB rare earth permanent magnet material is in a range of 0.4-0.9 wt %. The present invention finds that: when the content of Mn is higher than 0.3 wt %, a magnetic performance of NdFeB is obviously decreased. According to the present invention, the content of Mn is controlled in a range of 0.01 wt %≤Mn≤0.027 wt %, and further in a range of 0.011 wt %≤Mn≤0.027 wt %. When the content of Mn is controlled to be lower than 0.01 wt %, a production cost is obviously increased, and a practicability is lacking. When the content of Mn is controlled in the range of 0.01 wt %≤Mn≤0.027 wt %, an addition of Ti further improves the magnetic performance and a material toughness. The content of Ti is preferred to be 0.08 wt %≤Ti≤0.35 wt %.

Preferably, the grain boundary phase contains Nb; a content of Nb in the NdFeB permanent magnet is 0.3 wt %≤Nb≤1.2 wt %; the main phase further contains Gd and Ho; and contents of Gd and Ho in the NdFeB permanent magnet are respectively 0.3 wt %≤Gd≤4 wt % and 0.6 wt %≤Ho≤4.9 wt %.

Preferably, a content of Tb in the composite phase is higher than a content of Tb in the main phase and the grain boundary phase; and the content of Tb in the NdFeB permanent magnet is 0.1 wt %≤Tb≤2.8 wt %.

Preferably, contents of Tb and Al in the composite phase are higher than contents of Tb and Al in the main phase and the grain boundary phase; and the contents of Tb and Al in the NdFeB permanent magnet are respectively 0.1 wt %≤Tb≤2.8 wt % and 0.1 wt %≤Al≤0.6 wt %.

A method for producing a high-performance NdFeB permanent magnet with NdFeB scraps comprises steps of:

(a) under a vacuum condition, sending a portion of raw materials, comprising pure iron, ferro-boron, the NdFeB scraps and rare earth fluorides, into a crucible of a vacuum melting chamber, heating the portion of raw materials to a temperature of 1400-1500° C., refining the portion of raw materials, and obtaining a first melting liquid;

(b) sending a slag cleaning device to a surface of the first melting liquid in the crucible of the vacuum melting chamber, absorbing slags to the slag cleaning device, and moving the slag cleaning device out of the crucible;

(c) sending a rest of raw materials into the crucible of the vacuum melting chamber, filling argon into the vacuum melting chamber, refining the first melting liquid and the rest of raw materials in the crucible, obtaining a second melting liquid, pouring the second melting liquid after refining onto a surface of a water-cooled rotation roller through a tundish, forming alloy flakes, and controlling an average grain size of the alloy flakes in a range of 1.6-2.8 μm;

(d) sending at least two kinds of alloy flakes having different compositions into a vacuum hydrogen decrepitation furnace, and processing with a hydrogen decrepitation process; wherein: at least one kind of alloy flakes is prepared through the steps (a)-(c);

(e) sending the alloy flakes after the hydrogen decrepitation process into a nitrogen jet mill without discharging ultrafine powders, milling the alloy flakes into powders by the nitrogen jet mill, and controlling an average particle size of the powders in a range of 1.6-2.8 μm;

(f) under a protection of nitrogen, processing the powders with magnetic field pressing, and obtaining a pressed compact with a density controlled at 4.1-4.8 g/cm$^3$;

(g) under the protection of the nitrogen, sending the pressed compact after magnetic field pressing into a vacuum sintering furnace, processing the pressed compact with vacuum presintering, and obtaining a presintered block; and (h) processing the presintered block or a part obtained through machining the presintered block with vacuum sintering and aging, wherein a vacuum sintering temperature is controlled in a range of 960-1070° C. and an aging temperature is controlled in a range of 460-640° C.; and obtaining the NdFeB permanent magnet with a density controlled at 7.5-7.7 g/cm$^3$; wherein:

the NdFeB permanent magnet obtained through the above method has an average grain size in a range of 3-7 μm; the NdFeB permanent magnet contains N, F and Mn; a content of N is in a range of 0.03-0.09 wt %; a content of F is in a range of 0.004-0.5 wt %; and a content of Mn is 0.011 wt %≤Mn≤0.027 wt %.

Preferably, the rare earth fluorides comprise at least one member selected from a group consisting of praseodymium-neodymium fluorides, terbium fluorides, and dysprosium fluorides.

Preferably, a weight of the NdFeB scraps is 20-60% of a total weight of the raw materials; and a weight of the rare earth fluorides is 0.1-6% of the total weight of the raw materials.

Preferably, the step (a) comprises steps of: under the vacuum condition, sending the portion of raw materials, comprising the pure iron, the ferro-boron, the NdFeB scraps and the rare earth fluorides, into the crucible of the vacuum melting chamber; heating the portion of raw materials to the temperature of 1400-1500° C.; refining the portion of raw materials, wherein a vacuum degree is controlled in a range of $8\times10^{-1}$-$8\times10^{2}$ Pa; and obtaining the first melting liquid; and the content of Mn in the NdFeB permanent magnet is controlled in a range of 0.01-0.016 wt %.

Preferably, the step (d) comprises steps of: sending at least two kinds of alloy flakes having different compositions into the vacuum hydrogen decrepitation furnace, and processing with the hydrogen decrepitation process, wherein the hydrogen decrepitation process comprises steps of: firstly adding terbium fluoride powders into the alloy flakes; then heating the alloy flakes to a temperature of 50-800° C., and keeping the temperature for 10 minutes to 8 hours; cooling to 100-390° C.; absorbing hydrogen; heating the alloy flakes to a temperature of 600-900° C. and keeping the temperature; and cooling the alloy flakes to below 200° C.; and, in the NdFeB permanent magnet, the content of N is in the range of 0.03-0.09 wt %, the content of F is in a range of 0.005-0.5 wt %, and a content of Tb is in a range of 0.1-2.9 wt %.

Preferably, the step (c) comprises steps of: sending the rest of raw materials into the crucible of the vacuum melting chamber, filling the argon into the vacuum melting chamber, refining the first melting liquid and the rest of raw materials in the crucible, obtaining the second melting liquid, pouring the second melting liquid after refining onto the surface of the water-cooled rotation roller through the tundish, forming the alloy flakes, crushing the alloy flakes, falling into a water-cooled rotation cylinder by the crushed alloy flakes, and processing the alloy flake with secondary cooling.

Preferably, in the step (e), through "milling the alloy flakes into powders by the nitrogen jet mill", the obtained powders comprise ultrafine powders having a particle size smaller than 1 μm and common powders having a particle size larger than 1 μm; the ultrafine powders have a higher nitrogen content and a higher heavy rare earth element content than the common powders; and, after uniformly mixing the ultrafine powders and the common powders, the ultrafine powders surround the common powders.

Preferably, before "milling the alloy flakes into powders by the nitrogen jet mill", the step (e) further comprises a step of adding a lubricating agent into the alloy flakes after the hydrogen decrepitation process, wherein the lubricating agent contains F.

Preferably, in the step (g), through vacuum presintering, the presintered block is obtained, and a density of the presintered block is controlled at 5.1-7.2 g/cm$^3$; the step (h) comprises steps of: machining the presintered block into the part; removing oil from the part; immersing the part in a solution containing Tb—Al alloy powders; sending the part containing the Tb—Al alloy powders into the vacuum sintering furnace, and processing with vacuum sintering and aging, wherein the vacuum sintering temperature is controlled in a range of 1010-1045° C. and the aging temperature is controlled in a range of 460-540° C.; and obtaining the NdFeB permanent magnet with the density controlled at 7.5-7.7 g/cm$^3$; wherein: the NdFeB permanent magnet obtained through the above method has the average grain size in the range of 3-7 μm; in the NdFeB permanent magnet, the content of N is in the range of 0.03-0.09 wt %, the content of F is in a range of 0.05-0.5 wt %, and the content of Tb is in the range of 0.1-2.9 wt %; F exists in a grain boundary phase; a composite phase containing Tb and N exists between a main phase and the grain boundary phase; and the composite phase has a structure of $(R, Tb)_2T_{14}(B, N)$.

Preferably, in the step (g), through vacuum presintering, the presintered block is obtained, and the density of the presintered block is controlled at 5.1-7.2 g/cm$^3$; the step (h) comprises steps of: machining the presintered block into the part; removing the oil from the part; immersing the part in a solution containing terbium fluoride powders; sending the part containing the terbium fluoride powders into the vacuum sintering furnace, and processing with vacuum sintering and aging, wherein the vacuum sintering temperature is controlled in the range of 1010-1045° C. and the aging temperature is controlled in the range of 460-540° C.; and obtaining the NdFeB permanent magnet with the density controlled at 7.5-7.7 g/cm$^3$; wherein: the NdFeB permanent magnet obtained through the above method has the average grain size in the range of 3-7 μm; in the NdFeB permanent magnet, the content of N is in the range of 0.03-0.09 wt %, the content of F is in the range of 0.05-0.5 wt %, and the content of Tb is in the range of 0.1-2.9 wt %; F exists in the grain boundary phase; and a composite phase, having a Tb content higher than an average Tb content of the NdFeB permanent magnet, exists between the main phase and the grain boundary phase.

Preferably, in the step (g), through vacuum presintering, the presintered block is obtained, and the density of the presintered block is controlled at 5.1-7.4 g/cm$^3$; the step (h) comprises steps of: machining the presintered block into the part; attaching powders or a film containing Tb on a surface of the part; sending the part, with the surface attached by the powders or the film containing Tb, into the vacuum sintering furnace, and processing with vacuum sintering and aging, wherein the vacuum sintering temperature is controlled in the range of 1010-1045° C. and the aging temperature is controlled in the range of 460-540° C.; and obtaining the NdFeB permanent magnet with the density controlled at 7.5-7.7 g/cm$^3$, wherein: in the NdFeB permanent magnet, the content of N is in the range of 0.03-0.09 wt %, the content of F is in the range of 0.05-0.5 wt %, and the content of Tb is in the range of 0.1-2.9 wt %; alternatively, it is feasible to attach the powders containing Tb on the surface of the part through a pressure immersing method, or form the film containing Tb on the surface of the part through at least one method of sputtering, evaporating and spraying, then the part with the surface attached by the powders or the film containing Tb is sent into the vacuum sintering furnace and processed with vacuum sintering and aging.

Compared with machining after sintering, because the density after presintering is low, machining after presintering has obvious advantages that a machining cost is obviously decreased and a machining efficiency is increased by more than 30%.

The present invention has following beneficial effects.

The present invention finds that: after mixing first alloy flakes having an average grain size of 1.6-2.6 μm and second alloy flakes having an average grain size of 1.6-2.6 μm after the hydrogen decrepitation process, during a process of preparing the powders through the nitrogen jet mill without discharging the ultrafine powders, when an average particle size of the powders is in a range of 1.8-2.7 μm and an oxygen content is lower than 100 ppm, the ultrafine powders combine with the nitrogen and form the rare earth nitrides; and, through controlling a sintering process, after sintering, part of the rare earth nitrides enter the main phase and replace B, which increases the service temperature of the permanent magnet.

According to the prior art, although the ultrafine powder nitrides are also generated when preparing the powders, the ultrafine powder nitrides are discharged as the ultrafine powders. After discharging the ultrafine powders, the common powders combine with the nitrogen and form the rare earth nitrides. Because the rare earth nitrides have a large particle size, during sintering, part of nitrogen components of the rare earth nitrides are decomposed and discharged, and the other part of nitrogen components combine with the rich rare earth and form the rare earth nitrides existing in the grain boundary phase. According to the prior art, the rare earth nitrides are treated as impurities, and an existence of the rare earth nitrides is avoided. According to the present invention, the ultrafine powders are avoided being oxidized through controlling an oxygen content during the process of preparing the powders; through the jet mill without discharging the ultrafine powders, the rare earth nitrides, generated during the process of preparing the powders through the jet mill, are all recycled into powders collected by a collector; the nitrogen is adopted as a jet mill carrier, which enables all the ultrafine powders generated through the jet mill to be back to the collector, and the ultrafine powders react with the nitrogen and form the nitride micropowders containing the rare earth; because the rare earth nitrides are easily oxidized, during the subsequent producing processes, the oxygen content is strictly controlled and generally lower than 100 ppm; and, through improving the sintering process, part of the rare earth nitrides in the grain boundary move to the main phase, and a rare earth nitride phase connected with the main phase is generated at an edge of the grain boundary phase.

Because a lot of impurities and oxides are brought by the NdFeB scraps, which seriously affects the vacuum melting process and obviously decreases the product quality, the present invention, through adding the rare earth fluorides, especially through adding the praseodymium fluorides, the neodymium fluorides, the dysprosium fluorides and the terbium fluoride powders respectively or together, obtains the obvious effect. In the pure iron and the ferro-boron, which serve as the raw materials of NdFeB, the content of Mn is relatively high, which seriously affects the magnetic performance of NdFeB; and, how to decrease the content of Mn in the NdFeB rare earth permanent magnet is the difficult problem in the NdFeB industry. According to the present invention, through controlling the vacuum degree, controlling the refining temperature and adding the rare earth fluorides, the content of Mn is obviously decreased, generally controlled in the range of 0.011-0.027 wt % and further in the range of 0.011-0.016 wt %.

Compared with machining after sintering, because the density after presintering is low, machining after presintering has the obvious advantages that the machining cost is obviously decreased and the machining efficiency is increased by more than 30%.

These and other objectives, features, and advantages of the present invention will become apparent from the following detailed description, the accompanying drawings, and the appended claims.

DETAILED DESCRIPTION OF THE PREFERRED EMBODIMENT

Figure 1:
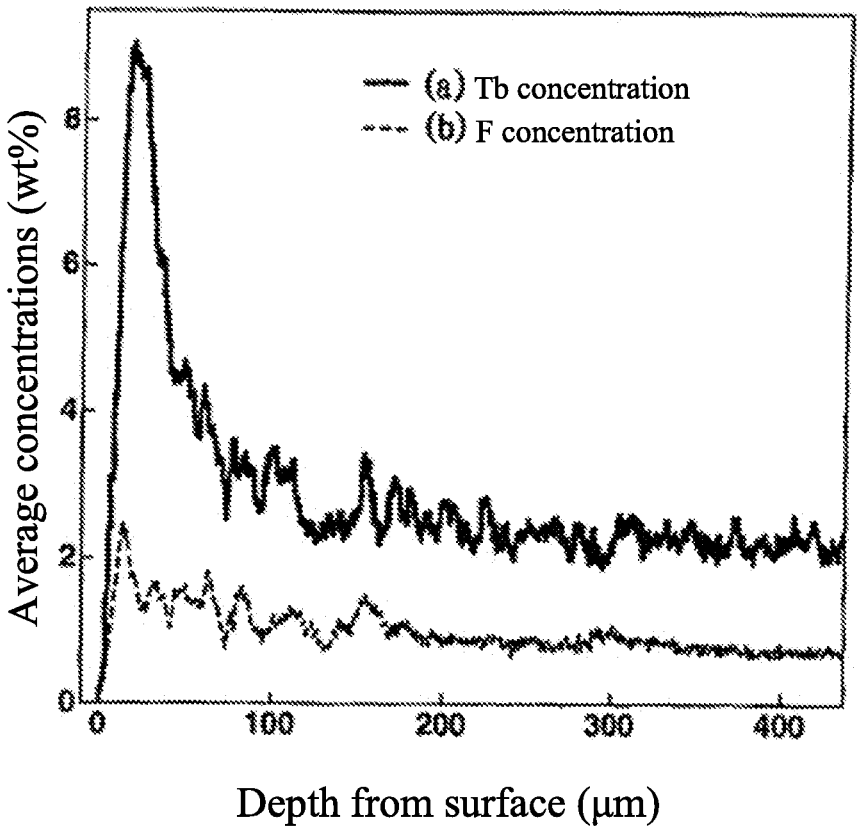
FIG. 1 (prior art)
FIG. 1 shows distribution trends of average concentrations of F and Tb in a magnet according to the prior art, wherein the average concentrations increase from a center of the magnet to a surface of the magnet.

Obvious effects of the present invention are further illustrated with following examples.

EXAMPLE 1

According to weight percent, preparing raw materials of praseodymium-neodymium alloys, metallic terbium, dysprosium fluorides, dysprosium-ferrum, pure iron, ferro-boron, metallic gallium, metallic zirconium, metallic cobalt, metallic aluminum and metallic copper, and NdFeB scraps into an alloy raw material having a composition of $Pr_{6.3}Nd_{23.1}Dy_2Tb_{0.6}B_{0.95}Co_{1.2}Zr_{0.12}Ga_{0.1}Al_{0.2}Cu_{0.2}Fe_{rest}$; loading the pure iron, the ferro-boron, the dysprosium fluorides, and a small amount of praseodymium-neodymium alloys into a first charging basket; loading the NdFeB scraps into a second charging basket; loading a rest of praseodymium-neodymium alloys, the dysprosium-ferrum, the metallic terbium, and the metallic gallium into a third charging basket; loading the metallic zirconium, the metallic cobalt, the metallic aluminum and the metallic copper into a fourth charging basket; sending the four charging baskets into a vacuum loading chamber of a vacuum melting rapid-solidifying device; after evacuating, opening the vacuum loading chamber and a vacuum valve of a vacuum melting chamber; through a cooperation among a lifting device, a multistage rotation plate, and a trolley which moves back and forth, sending the raw materials in the first charging basket and the NdFeB scraps in the second charging basket into a crucible of the vacuum melting chamber under a vacuum condition, heating to 1400-1500° C., refining, and obtaining a first melting liquid; through the lifting device, sending a NdFeB slag cleaning device to a surface of the first melting liquid in the crucible of the vacuum melting chamber, absorbing slags onto the slag cleaning device, and lifting the slag cleaning device up; sending the raw materials in the third charging basket and the fourth charging basket into the crucible of the vacuum melting chamber, filling argon into the vacuum melting chamber, refining the first melting liquid and the raw materials in the crucible, and obtaining a second melting liquid; after refining, tilting the crucible, pouring the second melting liquid onto a surface of a water-cooled rotation roller through a tundish, and forming an alloy flake material; leaving the water-cooled rotation roller and then falling into an alloy flake crushing device of an alloy flake cooling chamber by the alloy flake material, crushing the alloy flake material, then falling into a water-cooled rotation cylinder by the crushed alloy flake material, processing the crushed alloy flake material with secondary cooling, and forming first alloy flakes; sending the first alloy flakes and second alloy flakes having a composition of $(Pr_{0.25}Nd_{0.75})_{30.1}Fe_{rest}Co_{0.6}Al_{0.1}B_{0.95}Cu_{0.1}Ga_{0.1}Zr_{0.14}$ into a vacuum hydrogen decrepitation furnace, and processing with a hydrogen decrepitation process, wherein the hydrogen decrepitation process comprises steps of: adding terbium fluoride powders into the first and second alloy flakes, then heating the first and second alloy flakes to a temperature of 650° C., keeping the temperature at 650° C. for 2 hours, cooling to 260° C., absorbing hydrogen, heating the first and second alloy flakes to a temperature of 650° C. and keeping the temperature, and finally cooling the first and second alloy flakes to below 200° C.; sending the first and second alloy flakes after the hydrogen decrepitation process into a nitrogen jet mill without discharging ultrafine powders, milling the first and second alloy flakes into powders by the nitrogen jet mill, and controlling an average particle size of the powders at about 2.0-2.2 μm; processing the powders with magnetic field pressing, obtaining a pressed compact, and presintering the pressed compact into a presintered block with a presintered density of about 5.8 g/cm$^3$; machining the presintered block into a part, removing oil from the part, and immersing the part into a solution containing the terbium fluoride powders; sending the part containing the terbium fluoride powders into a vacuum sintering furnace, and processing with vacuum sintering and aging, wherein a vacuum sintering temperature is controlled at about 1040° C. and an aging temperature is controlled at about 505° C.; and, after subsequent processes, obtaining a NdFeB permanent magnet D1 with a density controlled at 7.5 g/cm$^3$.

Figure 2:
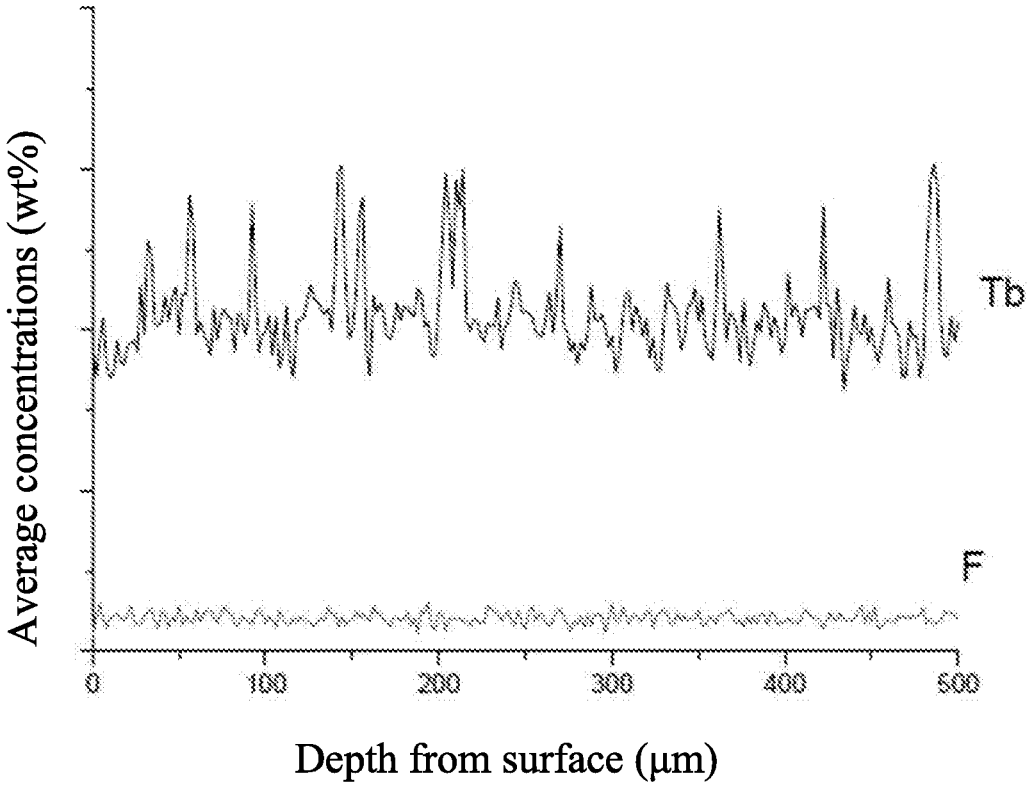
FIG. 2 shows distribution trends of average concentrations of F and Tb in a NdFeB permanent magnet D1, relative to a depth from a surface of the NdFeB permanent magnet D1, according to a first example of the present invention.

Through detecting, it is found that the NdFeB permanent magnet D1 has a magnetic energy product of 50 MGOe and a coercive force of 25 kOe. FIG. 2 shows distribution trends of average concentrations of F and Tb in the NdFeB permanent magnet D1, relative to a depth from a surface of the NdFeB permanent magnet D1. From FIG. 2, it is seen that F and Tb are relatively uniformly distributed in the NdFeB permanent magnet D1; and the average concentrations of F and Tb are not in a trend showed in FIG. 1 that gradually increases from a center of the magnet to a surface of the magnet. NdFeB permanent magnet products, in the same batch of the NdFeB permanent magnet D1, have few broken edges and corners, and a low rejection rate.

Alternatively, it is feasible to machine the presintered block into the part, and then immerse the part into any other solution containing powders of Tb, or attach the powders containing Tb on a surface of the part though a pressure immersing method, or form a film containing Tb on the surface of the part though at least one method of sputtering, evaporating and spraying; next, the part, with the surface attached by the powders or the film containing Tb, is sent into the vacuum sintering furnace and processed with vacuum sintering, aging, and subsequent processes. The formed permanent magnet has a similar magnetic performance as the NdFeB permanent magnet D1. Permanent magnet products, in the same batch of the permanent magnet, have few broken edges and corners, and a low rejection rate. F and Tb in the permanent magnet are relatively uniformly distributed in the permanent magnet, and average concentrations thereof are not in the trend showed in FIG. 1 that gradually increases from the center of the magnet to the surface of the magnet.

EXAMPLE 2

According to weight percent, preparing raw materials of praseodymium-neodymium alloys, metallic terbium, terbium fluorides, dysprosium-ferrum, pure iron, ferro-boron, metallic gallium, metallic zirconium, metallic cobalt, metallic aluminum and metallic copper, and NdFeB scraps into an alloy raw material having a composition of $Pr_{6.3}Nd_{23.1}Dy_{1.5}Tb_{1.0}B_{0.95}Co_{1.2}Zr_{0.12}Ga_{0.1}Al_{0.2}Cu_{0.2}Fe_{rest}$; loading the pure iron, the ferro-boron, the terbium fluorides, and a small amount of praseodymium-neodymium alloys into a first charging basket; loading the NdFeB scraps into a second charging basket; loading a rest of praseodymium-neodymium alloys, the dysprosium-ferrum, the metallic terbium, and the metallic gallium into a third charging basket; loading the metallic zirconium, the metallic cobalt, the metallic aluminum and the metallic copper into a fourth charging basket; sending the four charging baskets into a vacuum loading chamber of a vacuum melting rapid-solidifying device; after evacuating, opening the vacuum loading chamber and a vacuum valve of a vacuum melting chamber; through a cooperation among a lifting device, a multistage rotation plate, and a trolley which moves back and forth, sending the raw materials in the first charging basket and the NdFeB scraps in the second charging basket into a crucible of the vacuum melting chamber under a vacuum condition, heating to 1400-1500° C., refining, and obtaining a first melting liquid; through the lifting device, sending a NdFeB slag cleaning device to a surface of the first melting liquid in the crucible of the vacuum melting chamber, absorbing slags onto the slag cleaning device, and lifting the slag cleaning device up; sending the raw materials in the third charging basket and the fourth charging basket into the crucible of the vacuum melting chamber, filling argon into the vacuum melting chamber, refining the first melting liquid and the raw materials in the crucible, and obtaining a second melting liquid; after refining, tilting the crucible, pouring the second melting liquid onto a surface of a water-cooled rotation roller through a tundish, and forming an alloy flake material; leaving the water-cooled rotation roller and then falling into an alloy flake crushing device of an alloy flake cooling chamber by the alloy flake material, crushing the alloy flake material, then falling into a water-cooled rotation cylinder by the crushed alloy flake material, processing the crushed alloy flake material with secondary cooling, and forming third alloy flakes; sending the third alloy flakes and fourth alloy flakes having a composition of $(Pr_{0.25}Nd_{0.75})_{30.5}Fe_{rest}Co_{0.6}Al_{0.1}B_{0.95}Cu_{0.1}Ga_{0.1}Zr_{0.14}$ into a vacuum hydrogen decrepitation furnace, and processing with a hydrogen decrepitation process, wherein the hydrogen decrepitation process comprises steps of: adding terbium fluoride powders into the third and fourth alloy flakes, then heating the third and fourth alloy flakes to a temperature of 700° C., keeping the temperature at 700° C. for 2 hours, cooling to 260° C., absorbing hydrogen, heating the third and fourth alloy flakes to a temperature of 650° C. and keeping the temperature, and finally cooling the third and fourth alloy flakes to below 200° C.; sending the third and fourth alloy flakes after the hydrogen decrepitation process into a nitrogen jet mill without discharging ultrafine powders, milling the third and fourth alloy flakes into powders by the nitrogen jet mill, and controlling an average particle size of the powders at about 2.0-2.2 μm; processing the powders with magnetic field pressing, obtaining a pressed compact, and presintering the pressed compact into a presintered block with a presintered density of about 6.0 g/cm$^3$; machining the presintered block into a part, removing oil from the part, and immersing the part into a solution containing Tb—Al alloy powders; sending the part containing the Tb—Al alloy powders into a vacuum sintering furnace, and processing the part with vacuum sintering and aging, wherein a vacuum sintering temperature is controlled at about 1040° C. and an aging temperature is controlled at about 505° C.; and, after subsequent processes, obtaining a NdFeB permanent magnet D2 with a density controlled at 7.4 g/cm$^3$.

Through detecting, it is found that the NdFeB permanent magnet D2 has a magnetic energy product of 50 MGOe and a coercive force of 26 kOe. NdFeB permanent magnet products, in the same batch of the NdFeB permanent magnet D2, have few broken edges and corners, and a low rejection rate.

Alternatively, it is feasible to machine the presintered block into the part, and then immerse the part into any other solution containing powders of Tb, or attach the powders containing Tb on a surface of the part though a pressure immersing method, or form a film containing Tb on the surface of the part though at least one method of sputtering, evaporating and spraying; next, the part, with the surface attached by the powders or the film containing Tb, is sent into the vacuum sintering furnace and processed with vacuum sintering, aging, and subsequent processes. The formed permanent magnet has a similar magnetic performance as the NdFeB permanent magnet D2. Permanent magnet products, in the same batch of the permanent magnet, have few broken edges and corners, and a low rejection rate. F and Tb in the permanent magnet are relatively uniformly distributed in the permanent magnet, and average concentrations thereof are not in a trend showed in FIG. 1 that gradually increases from a center of the magnet to a surface of the magnet.

EXAMPLE 3

Preparing first alloy flakes with the same steps in the first example; sending the first alloy flakes and second alloy flakes having a composition of $(Pr_{0.25}Nd_{0.75})_{30.1}Fe_{rest}Co_{0.6}Al_{0.1}B_{0.95}Cu_{0.1}Ga_{0.1}Zr_{0.14}$ into a vacuum hydrogen decrepitation furnace, and processing with a hydrogen decrepitation process, wherein the hydrogen decrepitation process comprises steps of: heating the first and second alloy flakes to a temperature of 260° C., absorbing hydrogen, then heating the first and second alloy flakes to a temperature of 650° C. and keeping the temperature, and finally cooling the first and second alloy flakes to below 200° C.; with the same steps in the first example, milling the first and second alloy flakes into powders, processing the powders with magnetic field pressing, obtaining a pressed compact, presintering the pressed compact into a presintered block, machining the presintered block into a part, then removing oil from the part, and immersing the part into a solution containing terbium fluoride powders; sending the part containing the terbium fluoride powders into a vacuum sintering furnace, and processing the part with vacuum sintering and aging; and, after subsequent processes, obtaining a NdFeB permanent magnet D3.

Through detecting, it is found that the NdFeB permanent magnet D3 has a magnetic energy product of 49 MGOe and a coercive force of 24 kOe. NdFeB permanent magnet products, in the same batch of the NdFeB permanent magnet D3, have few broken edges and corners, and a low rejection rate.

Alternatively, it is feasible to machine the presintered block into the part, and then immerse the part into any other solution containing powders of Tb, or attach the powders containing Tb on a surface of the part though a pressure immersing method, or form a film containing Tb on the surface of the part though at least one method of sputtering, evaporating and spraying; next, the part, with the surface attached by the powders or the film containing Tb, is sent into the vacuum sintering furnace and processed with vacuum sintering, aging, and subsequent processes. The formed permanent magnet has a similar magnetic performance as the NdFeB permanent magnet D3. Permanent magnet products, in the same batch of the permanent magnet, have few broken edges and corners, and a low rejection rate. F and Tb in the permanent magnet are relatively uniformly distributed in the permanent magnet, and average concentrations thereof are not in a trend showed in FIG. 1 that gradually increases from a center of the magnet to a surface of the magnet.

CONTRAST EXAMPLE 1

According to weight percent, preparing raw materials of praseodymium-neodymium alloys, metallic terbium, dysprosium-ferrum, pure iron, ferro-boron, metallic gallium, metallic zirconium, metallic cobalt, metallic aluminum and metallic copper, and NdFeB scraps into an alloy raw material having a composition of $Pr_{6.3}Nd_{23.1}Dy_2Tb_{0.6}B_{0.95}Co_{1.2}Zr_{0.12}Ga_{0.1}Al_{0.2}Cu_{0.2}Fe_{rest}$; loading the pure iron, the ferro-boron, and a small amount of praseodymium-neodymium alloys into a first charging basket; loading the NdFeB scraps into a second charging basket; loading a rest of praseodymium-neodymium alloys, the dysprosium-ferrum, the metallic terbium, and the metallic gallium into a third charging basket; loading the metallic zirconium, the metallic cobalt, the metallic aluminum and the metallic copper into a fourth charging basket; melting with the same steps in the first example, and forming third alloy flakes having a same composition as the first alloy flakes; sending the third alloy flakes and second alloy flakes having a composition of $(Pr_{0.25}Nd_{0.75})_{30.1}Fe_{rest}Co_{0.6}Al_{0.1}B_{0.95}Cu_{0.1}Ga_{0.1}Zr_{0.14}$ into a vacuum hydrogen decrepitation furnace, and processing with a hydrogen decrepitation process, wherein the hydrogen decrepitation process comprises steps of: heating the third and second alloy flakes to a temperature of 260° C., absorbing hydrogen, heating the third and second alloy flakes to a temperature of 650° C. and keeping the temperature, and finally cooling the third and second alloy flakes to below 200° C.; sending the third and second alloy flakes after the hydrogen decrepitation process into a conventional nitrogen jet mill, milling the third and second alloy flakes into powders by the conventional nitrogen jet mill, and controlling an average particle size of the powders at about 3.3-3.6 μm; with the same steps in the first example, processing the powders with magnetic field pressing, obtaining a pressed compact, presintering the pressed compact into a presintered block, machining the presintered block into a part, then removing oil from the part, and immersing the part into a solution containing terbium fluoride powders; sending the part containing the terbium fluoride powders into a vacuum sintering furnace, and processing the part with vacuum sintering and aging; and, after subsequent processes, obtaining a NdFeB permanent magnet C1.

Through detecting, it is found that the NdFeB permanent magnet C1 has a magnetic energy product of 45 MGOe and a coercive force of 21 kOe.

CONTRAST EXAMPLE 2

According to weight percent, preparing raw materials of praseodymium-neodymium alloys, metallic terbium, dysprosium-ferrum, pure iron, ferro-boron, metallic gallium, metallic zirconium, metallic cobalt, metallic aluminum and metallic copper, and NdFeB scraps into an alloy raw material having a composition of $Pr_{6.3}Nd_{23.1}Dy_2Tb_{0.6}B_{0.95}Co_{1.2}Zr_{0.12}Ga_{0.1}Al_{0.2}Cu_{0.2}Fe_{rest}$; loading the pure iron, the ferro-boron, and a small amount of praseodymium-neodymium alloys into a first charging basket; loading the NdFeB scraps into a second charging basket; loading a rest of praseodymium-neodymium alloys, the dysprosium-ferrum, the metallic terbium, and the metallic gallium into a third charging basket; loading the metallic zirconium, the metallic cobalt, the metallic aluminum and the metallic copper into a fourth charging basket; melting with the same steps in the first example, and forming third alloy flakes having a same composition as the first alloy flakes; sending the third alloy flakes and second alloy flakes having a composition of $(Pr_{0.25}Nd_{0.75})_{30.1}Fe_{rest}Co_{0.6}Al_{0.1}B_{0.95}Cu_{0.1}Ga_{0.1}Zr_{0.14}$ into a vacuum hydrogen decrepitation furnace, and processing with a hydrogen decrepitation process, wherein the hydrogen decrepitation process comprises steps of: heating the third and second alloy flakes to a temperature of 260° C., absorbing hydrogen, heating the third and second alloy flakes to a temperature of 650° C. and keeping the temperature, and finally cooling the third and second alloy flakes to below 200° C.; sending the third and second alloy flakes after the hydrogen decrepitation process into a conventional nitrogen jet mill, milling the third and second alloy flakes into powders by the conventional nitrogen jet mill, and controlling an average particle size of the powders at about 3.3-3.6 μm; processing the powders with magnetic field pressing, obtaining a pressed compact, presintering the pressed compact with sintering and aging, and obtaining a sintered block, wherein a vacuum sintering temperature is controlled at about 1040° C., an aging temperature is controlled at about 505° C., and a density of the sintered block is controlled at 7.5 g/cm$^3$; machining the sintered block into a part, removing oil from the part, and immersing the part into a solution containing terbium fluoride powders; processing the part containing the terbium fluoride powders with a diffusing heat treatment at a temperature below the sintering temperature; and, after subsequent processes, obtaining a NdFeB permanent magnet C2.

Through detecting, it is found that the NdFeB permanent magnet C2 has a magnetic energy product of 45 MGOe and a coercive force of 21 kOe. NdFeB permanent magnet products, in the same batch of the NdFeB permanent magnet C2, have obviously more broken edges and corners than the products in the same batch of the NdFeB permanent magnet D1, the NdFeB permanent magnet D2 and the NdFeB permanent magnet C1, and a relatively high rejection rate.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A production method of a NdFeB permanent magnet produced with NdFeB scraps, wherein: an average grain size of the NdFeB permanent magnet is in a range of 3-7 μm; the NdFeB permanent magnet comprises a main phase and a grain boundary phase; the grain boundary phase is distributed around the main phase; the main phase contains Pr, Nd, Mn and Co; the grain boundary phase contains Zr, Ga, Cu and F; a composite phase containing Tb and N exists between the main phase and the grain boundary phase; and, contents of N, F, Mn, Tb, Pr, Nd, Co, Ga, Zr and Cu in the NdFeB permanent magnet are respectively 0.03 wt %≤N≤0.09 wt %, 0.005 wt %≤F≤0.5 wt %, 0.01 wt %≤Mn≤0.027 wt %, 0.1 wt %≤Tb≤2.9 wt %, 3 wt %≤Pr≤14 wt %, 13 wt %≤Nd≤28 wt %, 0.6 wt %≤Co≤2.8 wt %, 0.09 wt %≤Ga≤0.19 wt %, 0.06 wt %≤Zr≤0.19 wt %, and 0.08 wt %≤Cu≤0.24 wt %;

the production method comprising steps of:

(a) under a vacuum condition, sending a portion of raw materials, comprising pure iron, ferro-boron, the NdFeB scraps and rare earth fluorides, into a crucible of a vacuum melting chamber, heating the portion of raw materials to a temperature of 1400-1500° C., refining the portion of raw materials, and obtaining a first melting liquid;

(b) sending a slag cleaning device to a surface of the first melting liquid in the crucible of the vacuum melting chamber, absorbing slags onto the slag cleaning device, and moving the slag cleaning device out of the crucible;

(c) sending a rest of raw materials into the crucible of the vacuum melting chamber, filling argon into the vacuum melting chamber, refining the first melting liquid and the rest of raw materials in the crucible, obtaining a second melting liquid, pouring the second melting liquid after refining onto a surface of a water-cooled rotation roller through a tundish, forming alloy flakes, and controlling an average grain size of the alloy flakes in a range of 1.6-2.8 μm;

(d) sending at least two kinds of alloy flakes having different compositions into a vacuum hydrogen decrepitation furnace, and processing with a hydrogen decrepitation process; wherein: at least one kind of alloy flakes is prepared through the steps (a)-(c);

(e) sending the alloy flakes after the hydrogen decrepitation process into a nitrogen jet mill, milling the alloy flakes into powders by the nitrogen jet mill, and controlling an average particle size of the powders in a range of 1.6-2.8 μm;

(f) under a protection of nitrogen, processing the powders with magnetic field pressing, and obtaining a pressed compact with a density controlled at 4.1-4.8 g/cm$^3$;

(g) under the protection of the nitrogen, sending the pressed compact after magnetic field pressing into a vacuum sintering furnace, processing the pressed compact with vacuum presintering, and obtaining a presintered block; and (h) processing the presintered block or a part obtained through machining the presintered block with vacuum sintering and aging, wherein a vacuum sintering temperature is controlled in a range of 960-1070° C. and an aging temperature is controlled in a range of 460-640° C.; and obtaining the NdFeB permanent magnet with a density controlled at 7.5-7.7 g/cm$^3$; wherein:

the NdFeB permanent magnet obtained through the above method has the average grain size in the range of 3-7 μm; the NdFeB permanent magnet contains N, F and Mn; the content of N is in the range of 0.03-0.09 wt %; the content of F is in the range of 0.005-0.5 wt %; and the content of Mn is 0.011 wt %≤Mn≤0.027 wt %.

2. The production method of the NdFeB permanent magnet produced with the NdFeB scraps, as recited in claim 1, wherein the rare earth fluorides comprise at least one member selected from the group consisting of praseodymium-neodymium fluorides, terbium fluorides, and dysprosium fluorides.

3. The production method of the NdFeB permanent magnet produced with the NdFeB scraps, as recited in claim 1, wherein: a weight of the NdFeB scraps is 20-60% of a total weight of the raw materials; and a weight of the rare earth fluorides is 0.1-6% of the total weight of the raw materials.

4. The production method of the NdFeB permanent magnet produced with the NdFeB scraps, as recited in claim 1, wherein: in the step (a), a vacuum degree is controlled in a range of $8\times10^{-1}$–$8\times10^{2}$ Pa and the content of Mn in the NdFeB permanent magnet is controlled in a range of 0.01-0.016 wt %.

5. The production method of the NdFeB permanent magnet produced with the NdFeB scraps, as recited in claim 1, wherein the hydrogen decrepitation process comprises steps of: firstly adding terbium fluoride powders into the alloy flakes; then heating the alloy flakes to a temperature of 400-800° C., and keeping the temperature for 10 minutes to 8 hours; cooling the alloy flakes to 100-390° C.; absorbing hydrogen; heating the alloy flakes to a temperature of 600-900° C. and keeping the temperature; and finally cooling the alloy flakes to below 200° C.; and, in the NdFeB permanent magnet, the content of Tb is in a range of 0.1-2.8 wt %.

6. The production method of the NdFeB permanent magnet produced with the NdFeB scraps, as recited in claim 1, wherein: in the step (c), after pouring the second melting liquid after refining onto the surface of the water-cooled rotation roller through the tundish, the alloy flakes are formed; then the formed alloy flakes are crushed, fall into a water-cooled rotation cylinder, and are processed with secondary cooling.

7. The production method of the NdFeB permanent magnet produced with the NdFeB scraps, as recited in claim 1, wherein: in the step (e), through "milling the alloy flakes into powders by the nitrogen jet mill", the obtained powders comprise ultrafine powders having a particle size smaller than 1 μm and common powders having a particle size larger than 1 μm; the ultrafine powders have a higher nitrogen content and a higher heavy rare earth element content than the common powders; and, after uniformly mixing the ultrafine powders and the common powders, the ultrafine powders surround the common powders.

8. The production method of the NdFeB permanent magnet produced with the NdFeB scraps, as recited in claim 1, wherein: before "milling the alloy flakes into powders by the nitrogen jet mill", the step (e) further comprises a step of adding a lubricating agent into the alloy flakes after the hydrogen decrepitation process, wherein the lubricating agent contains F.

9. The production method of the NdFeB permanent magnet produced with the NdFeB scraps, as recited in claim 1, wherein: in the step (g), through processing the pressed compact with vacuum presintering, the presintered block is obtained, with a density controlled at 5.1-7.4 g/cm$^3$; the step (h) comprises steps of: machining the presintered block into the part, and attaching powders or a film containing Tb on a surface of the part; sending the part with the surface attached by the powders or the film containing Tb into the vacuum sintering furnace, and processing the part with vacuum sintering and aging, wherein the vacuum sintering temperature is controlled in a range of 1010-1045° C. and the aging temperature is controlled in a range of 460-540° C.; and obtaining the NdFeB permanent magnet with the density controlled at 7.5-7.7 g/cm$^3$; and, in the NdFeB permanent magnet, the content of F is in a range of 0.05-0.5 wt %, and the content of Tb is in the range of 0.1-2.9 wt %.

10. The production method of the NdFeB permanent magnet produced with the NdFeB scraps, as recited in claim 9, wherein: after machining the presintered block into the part, through a pressure immersing method, powders containing Tb are attached on the surface of the part, and then the part with the surface attached by the powders containing Tb is sent into the vacuum sintering furnace and processed with vacuum sintering and aging.

11. The production method of the NdFeB permanent magnet produced with the NdFeB scraps, as recited in claim 9, wherein: after machining the presintered block into the part, through at least one method of sputtering, evaporating and spraying, a film containing Tb is formed on the surface of the part, then the part with the surface attached by the film containing Tb is sent into the vacuum sintering furnace and processed with vacuum sintering and aging.

12. The production method of the NdFeB permanent magnet produced with the NdFeB scraps, as recited in claim 1, wherein: in the step (g), through processing the pressed compact with vacuum presintering, the presintered block is obtained, with a density controlled at 5.1-7.2 g/cm$^3$; the step (h) comprises steps of: machining the presintered block into the part, and immersing the part in a solution containing Tb—Al alloy powders; sending the part containing the Tb—Al alloy powders into the vacuum sintering furnace, and processing the part with vacuum sintering and aging, wherein the vacuum sintering temperature is controlled in a range of 1010-1045° C. and the aging temperature is controlled in a range of 460-540° C.; and obtaining the NdFeB permanent magnet with the density controlled at 7.5-7.7 g/cm$^3$; in the NdFeB permanent magnet, the content of F is in a range of 0.05-0.5 wt %, and the content of Tb is in the range of 0.1-2.9 wt %; F exists in the grain boundary phase; the composite phase containing Tb and N exists between the main phase and the grain boundary phase; and, the composite phase has a structure of $(R, Tb)_2T_{14}(B, N)$, wherein: T represents transition metal elements, and comprises Fe, Mn and Co; R represents at least one rare earth element, and comprises at least one of Pr and Nd.

13. The production method of the NdFeB permanent magnet produced with the NdFeB scraps, as recited in claim 1, wherein: in the step (g), through processing the pressed compact with vacuum presintering, the presintered block is obtained, with a density controlled at 5.1-7.2 g/cm$^3$; the step (h) comprises steps of: machining the presintered block into the part, removing oil from the part, and immersing the part in a solution containing terbium fluoride powders; sending the part containing the terbium fluoride powders into the vacuum sintering furnace, and processing the part with vacuum sintering and aging, wherein the vacuum sintering temperature is controlled in a range of 1010-1045° C. and the aging temperature is controlled in a range of 460-540° C.; and obtaining the NdFeB permanent magnet with the density controlled at 7.5-7.7 g/cm$^3$; in the NdFeB permanent magnet, the content of F is in a range of 0.05-0.5 wt %, and the content of Tb is in the range of 0.1-2.9 wt %; F exists in the grain boundary phase; and a composite phase having a Tb content higher than an average Tb content of the NdFeB permanent magnet exists between the main phase and the grain boundary phase.

* * * * *